US007029253B2

(12) United States Patent
Lin

(10) Patent No.: US 7,029,253 B2
(45) Date of Patent: Apr. 18, 2006

(54) PNEUMATIC TOOL HAVING A PNEUMATIC CYLINDER FOR AVOIDING FAILURE OF BEARINGS

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 153 days.

(21) Appl. No.: 10/722,533

(22) Filed: Nov. 28, 2003

(65) Prior Publication Data

US 2005/0118050 A1 Jun. 2, 2005

(51) Int. Cl.
*F01C 21/00* (2006.01)
*F03C 2/00* (2006.01)

(52) U.S. Cl. ..... 418/270; 418/104; 418/114; 418/133; 418/143; 418/149

(58) Field of Classification Search ..... 418/133, 418/134, 259, 268, 270, 104, 114, 149
See application file for complete search history.

(56) References Cited

U.S. PATENT DOCUMENTS 2,762,340 A * 9/1956 Roggenburk ..... 418/133
3,642,389 A * 2/1972 Chambers et al. ..... 418/270
3,880,245 A * 4/1975 Anderson, Jr. ..... 181/230
3,927,956 A * 12/1975 Linthicum ..... 418/270
5,947,712 A * 9/1999 Viegas et al. ..... 418/259

FOREIGN PATENT DOCUMENTS

FR 1197498 A * 12/1959
GB 2060076 A * 4/1981

* cited by examiner

*Primary Examiner*—Theresa Trieu
(74) *Attorney, Agent, or Firm*—Troxell Law Office, PLLC

(57) ABSTRACT

A pneumatic cylinder of pneumatic tool capable of avoiding failure of bearings, including: a cylinder body having an internal cylindrical chamber in which a rotor is disposed, a rotary shaft being fixedly connected with the rotor, whereby high pressure air can flow into the cylinder body to drive and rotate the rotor and the rotary shaft; two end caps respectively covering two ends of the cylinder body, two ends of the rotary shaft respectively extending out of the cylinder body through the through holes of the two end caps; two bearings respectively installed in the cavities of the two end caps and fitted on two ends of the rotary shaft; and two airtight rings located between the bottom walls of the cavities and the bearings to achieve an airtight effect between the bottom walls of the cavities and the bearings.

6 Claims, 4 Drawing Sheets

PNEUMATIC TOOL HAVING A PNEUMATIC CYLINDER FOR AVOIDING FAILURE OF BEARINGS

BACKGROUND OF THE INVENTION

The present invention is related to a pneumatic tool, and more particularly to a pneumatic cylinder of a pneumatic tool. The pneumatic cylinder is capable of avoiding loss of lubricant of the bearings so as to prolong the using life of the pneumatic cylinder.

FIG. 1 shows a conventional pneumatic cylinder 10 having a cylinder body 11. Referring to FIG. 2, the cylinder body 11 has an inlet 13 and at least one outlet 14, whereby the high pressure air can flow into the cylinder chamber 12 of the cylinder body and then flow out of the cylinder body. A rotor 15 is accommodated in the cylinder chamber 12 and fixedly connected with a rotary shaft 16. Two end caps 17 cover two ends of the cylinder body 11. The rotary shaft 16 extends out of the cylinder body 11 through the through holes 171 of the end caps 17. Two bearings 18 are located in the cavities 172 of the end caps 17 and fitted on two ends of the rotary shaft 16. When the rotary shaft rotates, the bearings 18 serve to support the rotary shaft.

The pneumatic cylinder 10 is mounted in a receiving space 19 of the pneumatic tool. After the high pressure air flows into the receiving space 19, the high pressure air will flow into the cylinder chamber 12 of the cylinder body 11 from the inlet 13 and then flow out from the outlet 14. When the high pressure air flows in the cylinder body, the high pressure air drives the rotor 15 and the rotary shaft 16 to rotate and operate.

The pneumatic tool utilizes high pressure air as power source so that the pressure of the air is quite high. In addition, a great amount of high pressure air is input into the cylinder chamber 12 and then exhausted from the outlet. The air cannot flow out from the outlet 14 in time will find other way to escape. Since the rotor and the rotary shaft rotate at high speed, a small gap exists between the wall of the through hole 171 of the end cap 17 and the rotary shaft 16 to avoid high heat caused by high speed friction. Accordingly, a little high pressure air in the cylinder chamber will quickly escape through the gap. Although the escaping air is little in comparison with the input air, such escaping air still has a considerable impact due to high pressure and high flowing speed. After flowing out from the through hole 171 of the end cap, the high pressure air flows through the gap between the bearing 18 and the cavity 172 into the bearing. After flowing into the bearing, the high speed air will blow out and dissipate the lubricant painted between the inner and outer rings 181, 182 of the bearing. After a period of time, the lubricant in the bearing will be totally lost.

In the case that the bearing lacks the lubricant, high heat will be generated in operation. Moreover, the components will directly abrade each other for a long time. This will lead to deformation and clog of the components. Practically, it is found that the high speed pneumatic tool such as pneumatic grinder often malfunctions after used for several months. The fault is caused by the failure of the bearings. As a result, a user needs to frequently service the pneumatic tool or purchase a new one.

Furthermore, after the lubricant is blown away from the bearing, the lubricant will splash over the wall face of the receiving space 19 of the pneumatic tool. Therefore, the receiving space will be contaminated by a great amount of dirt and dust. This often leads to faults of the components of the pneumatic tool.

SUMMARY OF THE INVENTION

It is therefore a primary object of the present invention to provide a pneumatic cylinder of pneumatic tool capable of avoiding failure of bearings. The pneumatic cylinder is capable of avoiding loss of lubricant of the bearings so as to prevent the pneumatic cylinder from malfunctioning.

It is a further object of the present invention to provide the above pneumatic cylinder of pneumatic tool capable of avoiding failure of bearings. The pneumatic cylinder is able to keep the receiving space of the main body of the pneumatic tool, in which the pneumatic cylinder is mounted clean.

The present invention can be best understood through the following description and accompanying drawings wherein:

DETAILED DESCRIPTION OF THE PREFERRED EMBODIMENT

Figure 1:
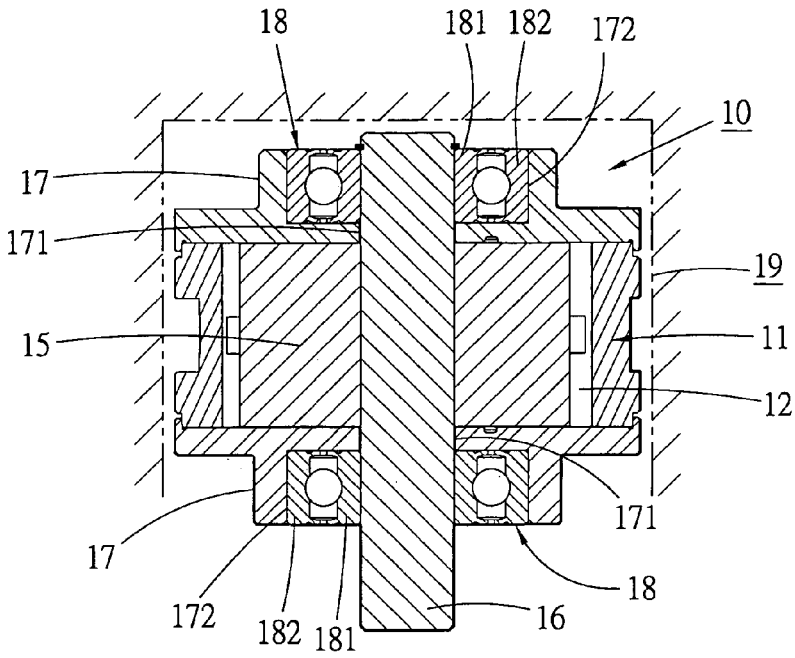
Fig. 1 Prior Art
FIG. 1 is a sectional view of the pneumatic cylinder of a conventional pneumatic tool.
Figure 2:
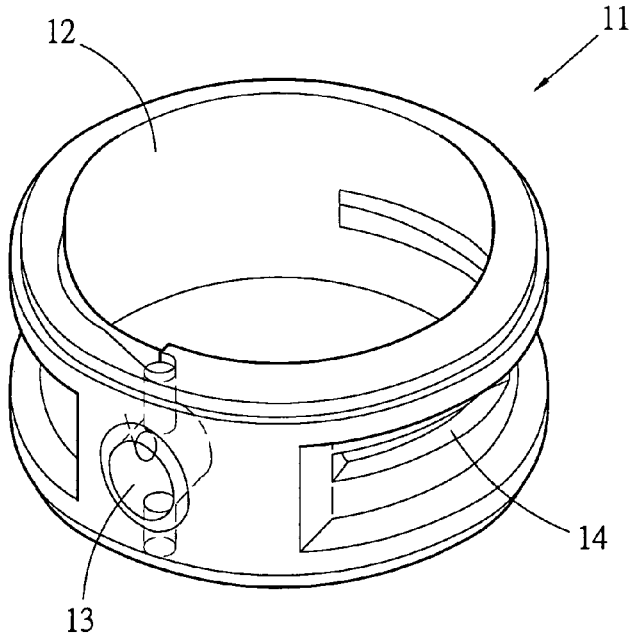
Fig. 2 Prior Art
FIG. 2 is a perspective view of the cylinder body of the conventional pneumatic cylinder of FIG. 1.
Figure 3:
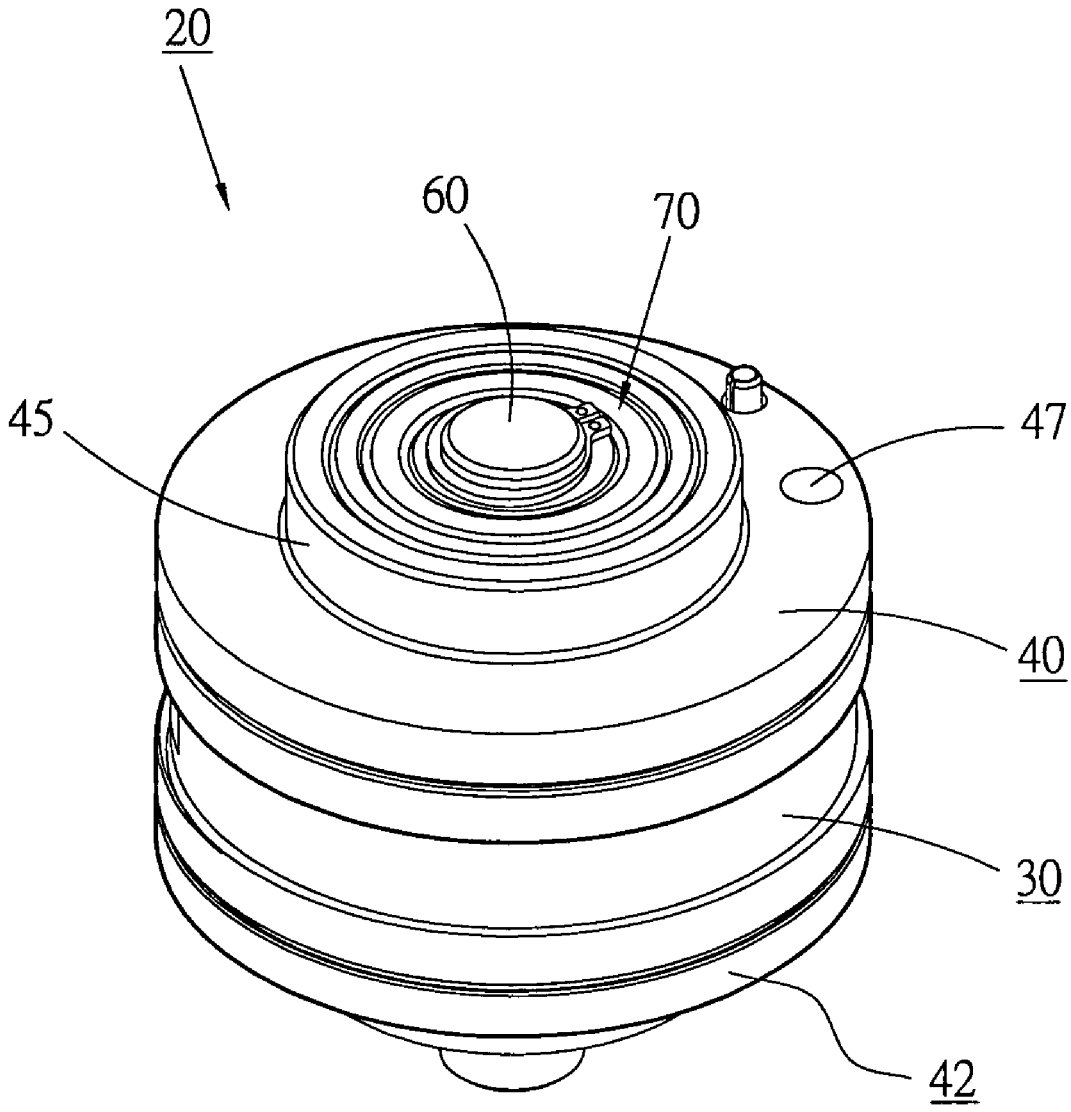
FIG. 3 is a perspective assembled view of a preferred embodiment of the present invention.
Figure 4:
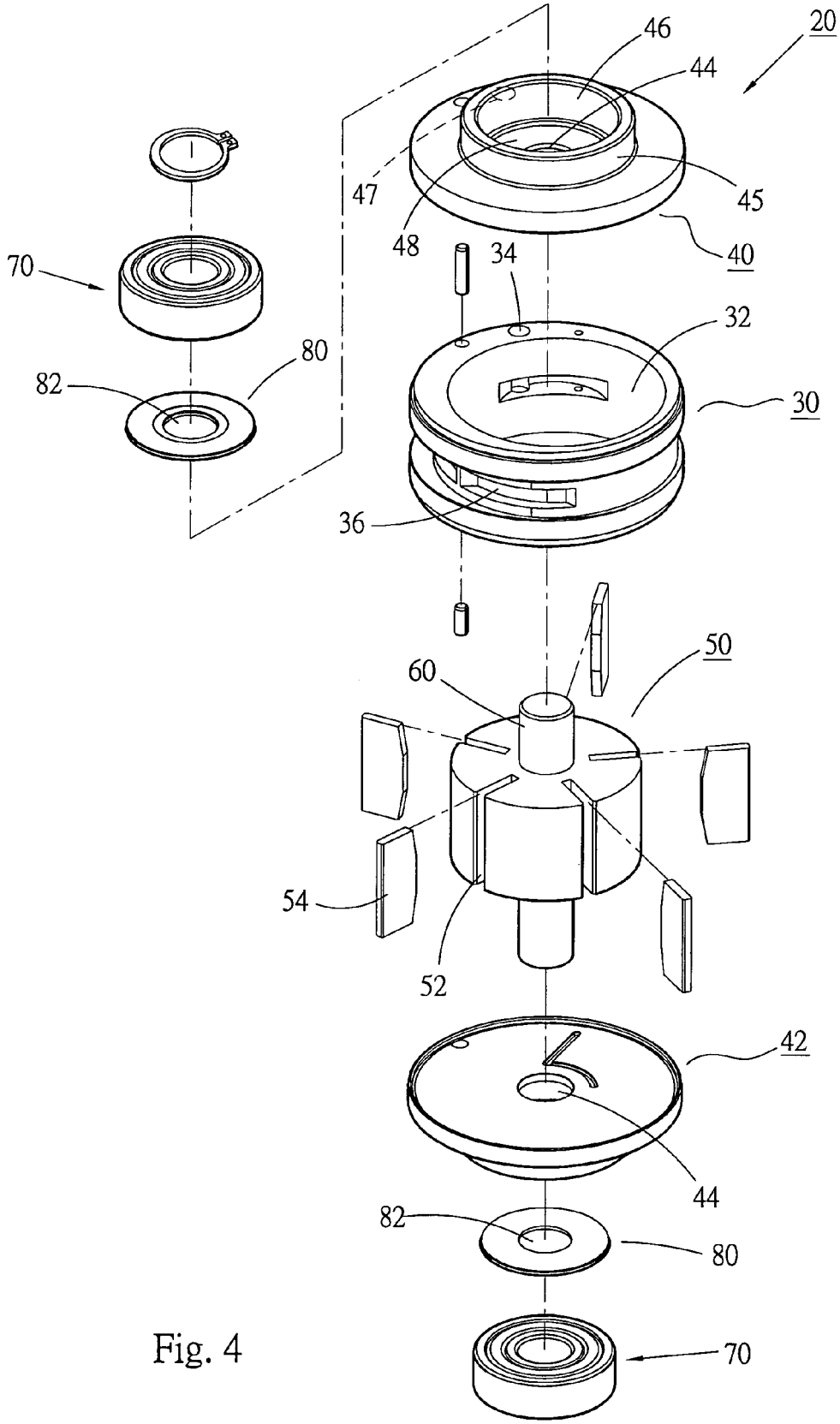
FIG. 4 is a perspective exploded view according to FIG. 3.

Please refer to FIGS. 3 and 4. According to a preferred embodiment, the pneumatic cylinder 20 of the pneumatic tool of the present invention includes a cylinder body 30 having an internal cylindrical chamber 32 passing through the cylinder body from top end to bottom end thereof. The wall of the cylinder body is formed with an inlet 34 and two outlets 36 communicating with the cylindrical chamber 32.

Figure 5:
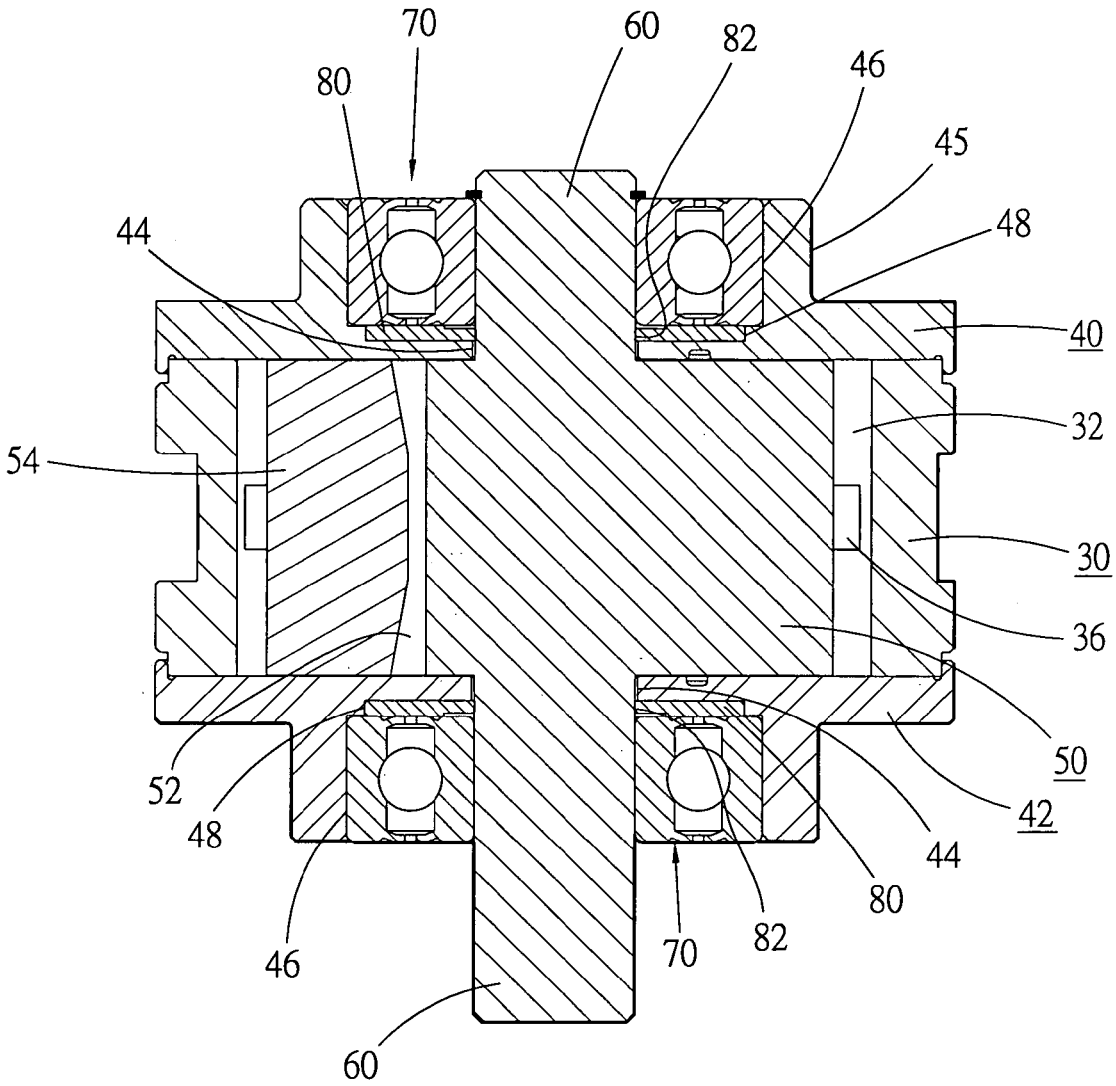
FIG. 5 is a longitudinal sectional view according to FIG. 3.

The present invention further includes a top end cap 40 and a bottom end cap 42 having identical structure. Each end cap is formed with a central through hole 44. One face of each end cap is formed with an annular projecting wall 45 defining a circular cavity 46. The cavity 46 coaxially communicates with the through hole. The two end caps 40, 42 respectively cover the top and bottom ends of the cylinder body 30 and are fixed by insertion pins to close two ends of the cylinder body 30 as shown in FIG. 5. In this embodiment, the inlet 34 is formed on one end face of the cylinder body 30 instead of the circumferential face of the cylinder body as in the conventional structure. The top end cap 40 is formed with a perforation 47 communicating with the inlet 34, whereby the air can flow into the cylindrical chamber. In this embodiment, the bottom wall of each cavity 46 is further recessed to form a circular dent 48.

The present invention further includes a rotor 50. The circumference of the rotor 50 is formed with five splits 52 in which five vanes 54 are respectively inserted.

The present invention further includes a rotary shaft 60. In this embodiment, the rotary shaft 60 is integrally formed with the rotor 50 and positioned at the center of the rotor 50. The rotary shaft 60 protrudes from the top and bottom ends of the rotor 50.

The rotor 50 and the rotary shaft 60 are rotatably mounted in the cylindrical chamber 32 of the cylinder body 30. Two ends of the rotary shaft 60 respectively extend out of the cylinder body through the through holes 44 of the two end caps 40, 42.

The present invention further includes two bearings 70 respectively installed in the cavities 46 of the two end caps 40, 42 and fitted on two ends of the rotary shaft 60 for supporting the rotor and rotary shaft during rotation.

The present invention further includes two airtight rings 80 which are annular plates made of rubber. Each airtight ring 80 is formed with a central through hole 82. The two airtight rings 80 are respectively disposed in the dents 48 of the bottom walls of the two cavities 46 and located between the bearings 70 and the bottom walls of the cavities 46. Two ends of the rotary shaft 60 extend through the through holes 82 of the airtight rings 80. The circumferences of the through holes 82 are engaged with the circumference of the rotary shaft. Accordingly, the airtight rings 80 achieve an airtight effect between the bottom walls of the cavities 46 and the end faces of the bearings 70. Also, the circumferences of the through holes 82 of the airtight rings are airtight engaged with the circumference of the rotary shaft so that the air is prevented from escaping through the through holes 44.

The pneumatic cylinder 20 is mounted in the receiving space of the main body of the pneumatic tool. The bottom end of the rotary shaft 60 is connected with a processing bit such as a grinding blade or chuck.

In use, after the high pressure air goes into the cylindrical chamber 32 of the cylinder body 30 through the inlet 34, the high pressure air exerts a pressure onto the vanes 54 of the rotor 50 to make the rotor and the rotary shaft 60 rotate. Then, the high pressure air is exhausted from the cylinder through the outlets 36. When the rotary shaft 60 rotates, the processing bit is driven to process a work piece.

The structure of the present invention achieves an airtight effect between the bottom walls of the cavities and the bearings to prevent the air from escaping. In addition, the airtight rings are airtight engaged with the rotary shaft. Therefore, the high pressure air in the cylindrical chamber is prevented from escaping through the through holes of the end caps. Accordingly, the air will be totally exhausted from the cylinder body through the outlets. This can enhance the rotational efficiency of the pneumatic cylinder. Also, the high pressure in the cylindrical chamber will not flow into the bearings so that the lubricant in the bearings will not be lost and the bearings can keep lubricated. After a period of use, the bearings will not clog. In other words, the pneumatic cylinder will not fault due to failure of the bearings and can have longer using life. This reduces the cost for the service or purchase. Furthermore, the lubricant will not be blown over the main body of the pneumatic tool so that the interior of the main body can keep clean without being contaminated by dirt and dust. This reduces the possibility of failure of the components.

In case there is still little air escaping from the through holes 44 of the end caps, since an airtight effect is achieved between the bottom walls of the cavities and the end faces of the bearings, the escaping air still cannot flow into the bearings so that it is ensured the lubricant in the bearings will not be lost.

What is claimed is:

1. A pneumatic cylinder of a pneumatic tool comprising:

a) a cylinder body having:
   i) an cylindrical chamber;
   ii) an inlet located in the in a wall thereof and communicating with the cylindrical chamber; and
   iii) a predetermined number of outlets communicating with the cylindrical chamber;

b) two end caps, one of the two end caps is located on each of two opposing ends of the cylindrical body, each of the two end caps having:
   i) a first central through hole;
   ii) an annular projecting wall; and
   iii) a circular cavity extending through the annular projecting wall and communicating with the first central through hole, the circular cavity having a circular dent located in a bottom thereof;

c) a rotor located in the cylindrical chamber and having a rotary shaft being fixed thereto, one of two ends of the rotary shaft being inserted through the first central through hole of each of the two end caps;

d) two bearings, one of the two bearings being located in the circular cavity of each of the two end caps; and e) two airtight rings, one of the two airtight rings being located in each circular dent between one of the two bearings and the bottom of the circular cavity of each of the two end caps, each of the two airtight rings having a second central through hole, one of two ends of the rotary shaft being inserted through the second central through hole of each of the two airtight rings.

2. The pneumatic cylinder according to claim 1, wherein each of the two airtight rings is an annular plate.

3. The pneumatic cylinder according to claim 2, wherein each of the two airtight rings providing an airtight seal between the second central through hole of one of the two airtight rings and each of the two ends of the rotary shaft.

4. The pneumatic cylinder according to claim 1, wherein each of the two airtight rings is made of rubber.

5. The pneumatic cylinder according to claim 4, wherein each of the two airtight rings providing an airtight seal between the second central through hole of one of the two airtight rings and each of the two ends of the rotary shaft.

6. The pneumatic cylinder according to claim 1, wherein each of the two airtight rings providing an airtight seal between the second central through hole of one of the two airtight rings and each of the two ends of the rotary shaft.

* * * * *